US006320092B1

(12) United States Patent
Vinnikov et al.

(10) Patent No.: US 6,320,092 B1
(45) Date of Patent: Nov. 20, 2001

(54) REMOVING AN EXPLOSIVE SUBSTANCE FOR REPROCESSING

(75) Inventors: Viktor Pavlovich Vinnikov; Viktor Petrovich Glinsky; Petr Stepanovich Davydov; Lev Pavlovich Kovyrzin; Alexandr Lvovich Manushin; Bronislav Vyacheslavovich Matseevich; Anatoly Polikarpovich Medvedev; Vyacheslav Konstantinovich Orlov; Nikolai Ivanovich Plekhanov; Alexandr Vasilievich Pshenitsyn; Nikolai Pavlovich Seleznev, all of Krasnoarmeisk; Valery Nikolaevich Panferov, Moscow; Viktor Mikhailovich Kuprinenok, Sankt-Peterburg, all of (RU)

(73) Assignee: Krasnoarmeisky Nauchno-Issledovatelsky Institut Mekmanizaishi, Krasnoarmeisk (RU)

( * ) Notice: Subject to any disclaimer, the term of this patent is extended or adjusted under 35 U.S.C. 154(b) by 0 days.

(21) Appl. No.: 09/284,185

(22) PCT Filed: Jul. 17, 1998

(86) PCT No.: PCT/EE98/00004

§ 371 Date: Apr. 9, 1999

§ 102(e) Date: Apr. 9, 1999

(87) PCT Pub. No.: WO99/08061

PCT Pub. Date: Feb. 18, 1999

(30) Foreign Application Priority Data

Aug. 11, 1997 (RU) ..... 97-0406

(51) Int. Cl.[7] ..... C05B 21/00; F42B 33/06

(52) U.S. Cl. ..... 588/202

(58) Field of Search ..... 588/202; 134/22.12, 134/22.14, 24, 23, 5; 149/88, 105, 106, 107, 109.6

(56) References Cited

U.S. PATENT DOCUMENTS

| | | | |
|---|---|---|---|
| 1,516,343 | 11/1924 | Knight . | |
| 5,737,709 * | 4/1998 | Getty et al. | 588/202 |

FOREIGN PATENT DOCUMENTS

| | | |
|---|---|---|
| 139207 | 2/1920 | (GB) . |
| 2056035 | 3/1996 | (RU) . |
| 1795962 | 2/1993 | (SU) . |
| 9534797 | 12/1995 | (WO) . |

* cited by examiner

*Primary Examiner*—Steven P. Griffin
*Assistant Examiner*—Eileen E. Nave
(74) *Attorney, Agent, or Firm*—Ladas and Parry

(57) ABSTRACT

A method and apparatus for removing an explosive substance for reprocessing heats a heat carrier to a melting point of a fusible component of the explosive substance, the heated heat carrier being a liquid having a density less than a density of any component of the explosive substance. The heated heat carrier is jetted onto a surface of the explosive substance for removing another component of the explosive substance from the surface in a suspension. The suspension is added to a separator filled with the heated heat carrier. When a weight limit of the explosive substance in the separator is reached, the mixture in the separator is stabilized and precipitated by holding in the separator for at least 10 minutes. A predetermined weight of melted trotyl is added to the mixture in the separator and the mixture mixed to a homogeneous mass for discharge.

3 Claims, 1 Drawing Sheet

REMOVING AN EXPLOSIVE SUBSTANCE FOR REPROCESSING

The claimed technical solution relates to the field of ammunition utilization and in particular, to removing explosive substances consisting of a mixture of fusible and non-fusible components from a casing and simultaneously preparing explosive compositions of a predetermined formulation on the basis of extracted materials.

A method is known in the related art to be used for discarding ammunition, said method being based on removing explosive substances from an ammunition casing by supplying a liquid heat-carrier that is inert with respect to the components of explosive substances, into the casing under a pressure of 0.1 to 20 atm and at a temperature of 80 to 130° C. through a nozzle (RF Patent 2,056,035, Int. Cl. F42B 33/00, publ. 1996).

This method is suitable for removing a charge of explosive substances from ammunition, but it does not provide for separation of the heat-carrier from the explosive substances being removed, and this leads to accumulation of explosive substances in the heat-carrier and enhances the danger of the discarding process as well as does not allow to use the heat-carrier many times in the technlogical cycle. In addition, this method cannot be used to prepare an explosive composition of a predetermined formulation.

Also, a method is known in the related art to be used for utilization of waste materials containing mixed solid fuel, said method providing for mixing a liquid industrial explosive substance with a predetermined quantity of waste materials (PCT/US94/00406, Int. Cl. C06B 17/14, publ. 1994).

The above method allows to solve a particular problem. A mixed solid fuel is mixed with brisant explosive substances to produce thereby high-energy compositions.

The above method for removing a charge of explosive substances does not solve the problem of removing explosive substances from ammunition casings and preparing industrial explosive substances on their basis.

Besides, a method is also known in the related art to be used for destruction of articles made of explosive substances with simultaneous utilization of these explosive substances, said method consisting in that working medium is supplied onto the surface of an article made of explosive substances at a temperature of 30 to 180° C. and under pressure of 0.01 to 10,000 kg/cm$^2$, and the resulting mixture of the working medium with the article destruction products is jointly processed into granules or castings of an industrial explosive substance having a predetermined oxygen balance.

As such working medium, use is made of melted or suspended ammonium nitrate and/or carbamide with purposive additives, wherein used as such are sodium nitrate,or mineral oil, or metallic powders,or water,or paraffine and mineral oil (RF Patent 1,795,962, Int.Cl. G06B 21/00, publ. 1993—the most relevant prior art prototype).

The above method has a number of disadvantages.

The working medium is continuously consumed and is included in the composition of the industrial explosive substance thus being prepared. The most efficient removal of explosive substances from ammunition casings, as shown by discarding investigations at pressures of 0.01 to 10 kg/cm$^2$, is accomplished at modulus 1 . . . 50 . . . 100, i.e., in order to remove 1 kg of explosive substances, it is necessary to introduce 50 . . . 100 kg of the working medium into an ammunition casing. If fresh working medium is used at all times, it will be then needed in large quantities.

For instance, in order to remove 1.5 t of trotyl from an aviation bomb Calibre 3000, it is necessary to use 105 t of working medium, and this involes a substantial power consumption.

The problem of separating the explosive substances from the working medium is not solved by the above method.

And, wash-out by the working medium containing the extracted explosive substance is dangerous. Solid additives (metallic powders, carbamides), if added, also enhance the danger of the removal process.

The above method also does not solve the problem of proportions between various components included in an industrial explosive substance.

Equipment (apparatuses) are known in the related art to be used for carrying out a process of discarding ammunition of artillery and other types (British Patent No. 139207, Int. Cl. F42B 33/06—the most relevant prior art prototype).

In this equipment, a pump and a nozzle are arranged to be disposed so that water from a collector flows to the nozzle and then from the nozzle into shells which are located each under an individual nozzle. An offtake channel located lower than a shell holder provides a discharge of the water flow containing ingredients of the bursting charge in dissolved condition or in a form of suspension. A settling chamber and an overflow pipe are arranged to be disposed between the offtake channel and the water collector for catching heavier particles and for receiving the discharged water flow containing water-soluble compounds.

This equipment possesses the following disadvantages.

As a result of a leaky connection between the nozzle and the casing of the article being washed out and existence of open offtake channels and apparatuses, there takes place an ejection of water vapours and removed explosive substance vapours into the room, and this sharply affects ecological and sanitary environment.

Evacuation of the removed explosive substance from the settling chamber is impeded, and adequate purification of water is not ensured.

The removed explosive substance in the settling chamber has a high moisture content, and this hampers its repeated use and leads to the necessity of explosion and fire hazardous drying.

It is impossible to prepare an explosive composition of a predetermined formulation on the basis of the extracted explosive substance.

All the disadvantages of the most relevant prior art prototype are non-existent in the claimed technical solution.

Extraction is carried out with the use of a neutral heat-carrier which, after it removes the explosive substance out of the ammunition casing, is separated from the explosive substance and, being pure, is recycled to the casing.

Thus, the working medium is practically not consumed during the washing-out process. The same working medium can be used for several months of continuous operation.

During the washing-out and separation process, evaporation of melted trotyl is avoided due to leak-proofness of pipelines and apparatuses.

The disclosed method is realized by means of a device (separator) which ensures the separation of explosive substance and working medium.

Wash-out by a pure working inedium that is neutral to explosive substances, is a safe process. The bulk of extracted explosive substances is continuously weighed. Thus, their proportion is continuously maintained.

When creating the present invention, a problem was posed to develop an efficient and no-waste technique for extracting and processing explosive substances while making it simultaneously more ecologically favourable by incorporating therein a number of operations and by including novel design features in the device.

When carrying out the group of inventions directed at such a subject matter as "Method", the technical result is attainable owing to that the explosive substances are removed out of the casing by supplying an inert, liquid and pressurized heat-carrier heated to a predetermined temperature onto the surface of said explosive substances through a movable nozzle, whereupon the charge destruction product is processed into an industrial explosive substance.

The removal of explosive substances out of the ammunition casing is carried out due to a heat transfer from the working mediuim to the charge and a wash-out of the softened explosive substance out of the casing. Processing of the resulting mixture consists in the following:

- the mixture of the extracted explosive substance and the heat-carrier is continuously precipitated and weighed in the process of accumulating the sediment within the separator;
- as soon as a predetermined loading weight is reached in the separator, the supply of the heat-carrier and the removal of the explosive substance are interrupted;
- the heat-carrier is clarified in the separator by settling;
- a predetermined quantity of melted trotyl is added thereto;
- the melted heat-carrier is drained from the separator until a predetermined level is reached therein;
- the mixture remaining in the separator is then kneaded until a homogeneous composition is obtained, whereupon it is drained into a collector for melted explosive substances.

The claimed method is realized by means of a device which has the distinguishing features thereof consisting in the following:

- the separator is mounted on scales and comprises a mixing device and a flow stabilizer connected to a discharge duct;
- a supply device for the liquid heat-carrier is made in the form of a hollow movable bar with a nozzle;
- the separator is connected to the collector for the finished product via a bottom discharge connection and to the supply device for the liquid heat-carrier via two lateral connections, wherein the lower lateral discharge connection is positioned relative to said bottom connection at a level determined from the formula:

$$H = \frac{V_1 + V_2}{S},$$

where $V_1$=volume occupied by the extracted explosive substance and the dose of trotyl;

$V_2$=volume occupied by the remaining melted heat-carrier after discharge; and

S=cross-section of the separator;

- the discarge duct is connected to a trotyl melter;
- the flow stabilizer is made so as to have a slotted outlet within the lower portion thereof, arranged concentrically with the separator wall;
- the joints of the flow stabilizer, bottom connection and lateral connections with external ducts are made flexible and hermetically sealed;
- the supply device for the heat-carrier is located lower than the lower lateral discharge connection and has a capacity that is larger than the volume of heat-carrier discharged from the separator.

As a result of continuous weight control of the sediment bulk, it becomes possible to prepare an explosive composition of a predetermined formulation from the sediment.

The separator is mounted on the scales and comprises a mixing device and a flow stabilizer connected to the discharge duct, and this allows to ensure a reduction in the velocity and turbulence of the suspended explosive substance and paraffine flow draining off into the separator. In this case, the conditions improve for precipitation of explosive substance components in the separator.

Existence of the weighing device enables to monitor continuously the sediment in the settler in order to interrupt the process of removing the explosive substance from the ammunition as soon as a designed quantity thereof is accumulated.

Design features of the separator ensure favourable conditions for discharging the composition thus prepared into the collector for the melted explosive substances, the heat-carrier —into the supply device for supplying it into the annumition casing, and the metered dose of melted trotyl—into the separator.

The flow stabilizer has a slatted outlet within the lower portion thereof, arranged concentrically with the wall, and this ensures a reduction in the velocity and eliminates the turbulence of the draining-off flow, thus creating favourable conditions for precipitation of the suspended explosive substances within the bottom portion of the separator.

The joints of the flow stabilizer, bottom connection and lateral connections with external ducts are made flexible and hermetically sealed, thereby eliminating any influence of rigid links on operation of the scales as well as emission of noxious substances into the room.

The device for discarding ammunition is illustrated by the drawings presented in FIGS. 1 and 2.

Figures 1, 2:
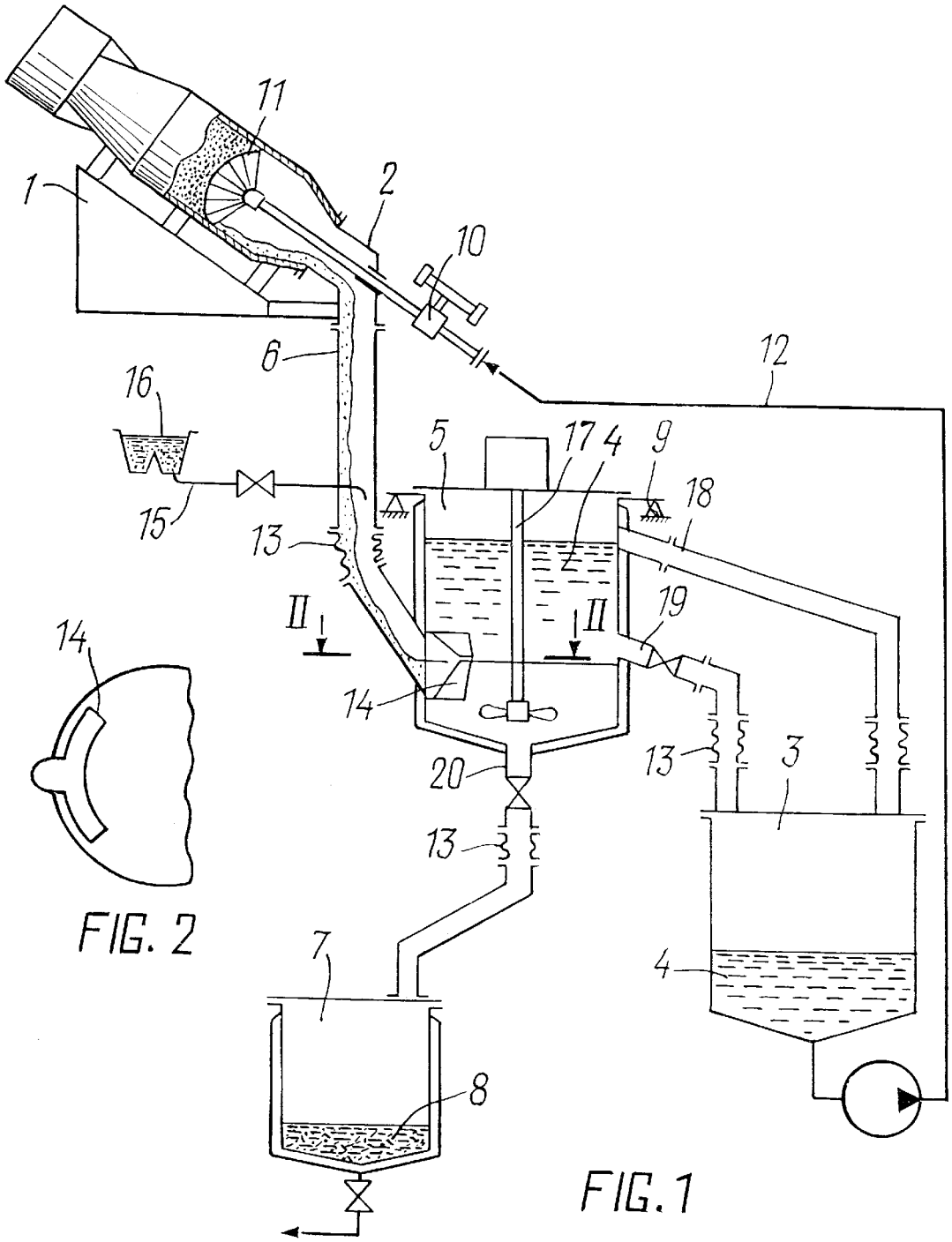
FIG. 1 shows a general view of the device.
FIG. 2 shows a sectional view along line II—II.

The device (FIG. 1) comprises a hopper 1 with an inlet funnel 2, a supply device 3 for a liquid heat-carrier 4, a separator 5, a discharge duct a, a collector 7 for a melted finished product 8, and a weight measuring device 9 with sensors.

The supply device 3 for the liquid heat-carrier comprises a movable hollow bar 10 with a perforated nozzle 11, and a duct 12, and it is connected to the inlet funnel 2 which is also coupled with the discharge duct 6. The movable bar 10 with the nozzle 11 executes alternately reciprocating and back-and-forth rotational motions.

The discharge duct 6 is connected through a flexible joint 13 to the separator 5 and comprises a flow stabilizer 14 (FIG. 2). A supply pipe 15 is inserted into the discharge duct 6 to supply doses of melted trotyl from a melter 16.

The separator 5 is connected to the sensors of the weight measuring device 9 and provided with a mixing device 17 as well as with an upper lateral connection 18, a lower lateral connection 19 and a bottom connection 20. Through the lateral connections 18, 19 and flexible joints, the separator 5 is connected to the supply device 3 for the heat-carrier, and through the bottom connecticon 20—to the collector 7 for the melted finished product.

The device for discarding ammunition comprising mixed charges with simultaneous production of an explosive substance operates as follows.

A discarded ammunition is prepared for removing the charge therefrom. In doing so, the removable parts are taken off (covers, plugs), sinkage is relieved from the threads, and intermediate detonators are withdrawn.

The ammunition thus prepared is placed by means of a hoisting mechanism onto the hopper 1 in an inclined position with it throat down and joined tightly with the inlet funnel 2 and the discharge duct 6. The bar 10 with the perforated nozzle at its end is inserted through the filling throat of the ammunition into the ammunition casing.

The reservoir of the supply device 3 for the liquid heat-carrier 4 is filled up with melted heat-carrier, for instance, paraffine, which is heated up to a temperature of 100 . . . 125° C. The separator 5 is then weighed, and the value of its weight is zeroed. A predetermined dose of trotyl is loaded into the melter 16 where it is melted.

This is a final step in preparing equipment of the discarding device to operation.

The pump drive of then supply device 3 for the liquid heat-carrier 4 is switched on. The melted heat-carrier 4 is delivered over the pressure duct 12 and bar 10 through the perforated nozzle 11 into the ammunition chamber. Jets of the heat-carrier wash out the open surface of the charge. As this takes place, the explosive substance melts and forms a complex mixture with the heat-carrier, which mixture flows by gravity through the inlet funnel 2 and the discharge duct 6 into the separator 5. In the flow stabilizer 14 with which the separator 5 is provided, a reduction in the liquid flow velocity occurs due to an increase in the flow section in the slotted outlet and to the distribution of the flow over the wall of the separator. This reduces turbulence, thus conducing to the precipitation of the mixed explosive substance components which have the density thereof 1.5 to 3 times that of the melted heat-carrier. The separator 5 is filled up with liquid until the upper lateral discharge connection 18 is reached (every time this happens the lower lateral connection 19 is closed by its valve).

The melted heat-carrier with a small admixture of the extracted explosive substance will flow by gravity into the reservoir of the supply device 3 for the liquid heat-carrier 4, whilst the major bulk of the extracted explosive substance is being accumulated in the form of sediment within the bottom portion of the separator 5. With the help of the scales 9, the loading weight of the separator 5 is continuously monitored.

As soon as a predetermined weight is reached which has its value determined from the proportions of components in the composition being prepared, the pump drive of the supply device 3 for the liquid heat-carrier 4 is switched off, and the process of removing the explosive substance out of the ammunition is interrupted. After completing the removal of explosive substance, some time is given to allow the liquid to drain off completely from the ducts, and the heat-carrier to clarify by precipitating fine fraction of the extracted explosive substance suspended therein. Then a valve is opened on the pipe 15, and a predetermined dose of the melted trotyl is discharged into the separator 5. In so doing, an excess of the heat-carrier 4 is displaced out of the separator through the upper lateral connection 18 into the reservoir of the supply device 3 for the liquid heat-carrier 4. After this, the valve is opened on the lower lateral discharge connection 19 of the separator 5.

The heat-carrier drains off from the separator 5 into the reservoir of the supply device 3 for the liquid heat-carrier until the level is reached therein as defined by the location of the connection 19. In the separator, a mixture is formed from the components, consisting of the sediment of the extracted explosive substance, the dose of melted trotyl and the remaining melted heat-carrier and corresponding to the predetermined content of these components in the explosive composition 8 being prepared.

The valve is then closed on the connection 19, and the drive of the mixing device 17 is switched on. The components of the explosive composition 9 are then kneaded until a homogeneous composition is obtained. Next, the valve is opened on the bottom connection 20, and the composition 8 thus prepared is discharged into the collector 7 for the melted explosive substances. Further, the mixture is delivered from the collector 7 for subsequent processing, for instance, granulation. The flexible and hermetically sealed joints 13 of the ducts and apparatuses eliminate emission of noxious substances into the room and any influence of rigid links on the results of weighing.

Removal of the charge from the ammunition is continued until its casing is absolutely empty, by repeating the cycles of preparing the explosive composition of a predetermined formulation.

So, the explosive composition thus being prepared will include a sediment of the extracted explosive substance removed from the ammunition being discarded, melted trotyl and melted heat-carrier, for instance, paraffine. The quantities of trotyl and heat-carrier to be introduced will depend on the proportions of components in the charge of the ammunition being discarded and are to be determined by means of a calculation.

What is claimed is:

1. A method for removing and reprocessing mixed explosive substances, removed from ammunition, wherein the method comprises:

heating an inert heat carrier to a melting point of a fusible component included in a formulation of an explosive substance to be removed, and supplying the inert heat carrier under pressure into an ammunition casing onto a surface of the explosive substance, wherein said heat carrier has a density which is less than the density of each component of the explosive substance, filling a separator with the inert heat carrier, the separator being provided with first, second, third and fourth connections mounted from the top downwards in respect to the height of the separator to a level of the first connection, and determining the weight of said heat carrier, continuously supplying a mixture of the removed explosive substance and the inert heat carrier into the separator through the third connection in a turbulent flow in which the removed explosive substance is in a suspended state, wherein an upper layer of the inert heat carrier in a volume equal to a volume of the supplied mixture is continuously drained from the separator through the first connection, subjecting the mixture in the separator to stabilization, precipitation and continuous weighment, setting an upper limit to a weight of the mixture of the explosive substance and the inert heat carrier in the separator, and when said limit is reached interrupting the supply of the inert heat carrier into the ammunition casing and accordingly said mixture into the separator, holding a content of the separator for at least 10 minutes, wherewith the inert heat carrier is separated from the explosive substance, adding to the separator melted trotyl through the third connection, simultaneously discharging an amount of inert heat carrier equal a volume of the trotyl from the separator through the first connection, and then discharging separated and clarified inert heat carrier through the second connection to form a mixture of explosive substance and trotyl, mixing the mixture of explosive substance and trotyl to obtain a homogeneous mass, and discharging from the separator through the fourth connection the homogeneous mass into an additional vessel for subsequent reprocessing.

2. A method according to claim 1, wherein the melting point of the fusible component included in the formulation of the explosive substance to be removed is within a range of from 100° C. to 125° C.

3. A device for removing and reprocessing mixed explosive substances removed from an ammunition casing, comprising a separator provided with a housing and a mixing device and mounted on scales, first, second, third and fourth connections mounted on the separator along its height, respectively, wherein the first connection, mounted on a side wall of the separator, serves for discharging clarified heat carrier, the second connection, mounted on a side wall of the separator, serves for discharging separated heat carrier, the third connection, mounted on a side wall of the separator, serves for receiving a mixture of heat carrier and removed mixed explosive substances, and the fourth connection, mounted in the bottom of the separator, serves for discharging an obtained mixture, a stabilizer mounted in the separator opposite said third connection in a form of a slot funnel, a vessel for the heat carrier, which is provided with a housing and pump, a nozzle with a hollow bar, communicating by means of a pressure duct with a pump and serving to feed heated heat carrier under pressure into the ammunition casing onto a surface of the mixed explosive substances, an inlet funnel for joining to a neck of the ammunition casing, a discharge duct for connecting the inlet funnel to the third connection, a vessel for preparing an amount of melted trotyl, connected by means of a branch pipe to the discharge duct, a collector for receiving the obtained mixture, connected to the fourth connection, wherein the second connection is positioned relative to the fourth connection at a level determined from the equation:

$$H = \frac{V1 + V2}{S}$$

wherein V1 is volume occupied in the separator by removed mixed explosive substances and the amount of melted trotyl, V2 is volume occupied by the heat carrier after the discharges of the separated and clarified heat carriers, S is the cross section of the separator.

* * * * *

UNITED STATES PATENT AND TRADEMARK OFFICE

CERTIFICATE OF CORRECTION

PATENT NO. : 6,320,092 B1 
DATED : November 20, 2001
INVENTOR(S) : Viktor Pavlovich Vinnikov et al.

It is certified that error appears in the above-identified patent and that said Letters Patent is hereby corrected as shown below:

Title page,
Item [73], "Mekmanizaishi" should read -- Mekhanizatsii --,
Item [86], "PCT/EE98/00004" should read -- PCT/EA98/00004 --, and
Item [30], "97-0406" should read -- EA-97-0406-RU --.

Signed and Sealed this

Sixteenth Day of July, 2002

*Attest:*

*Attesting Officer*

JAMES E. ROGAN
*Director of the United States Patent and Trademark Office*